United States Patent [19]

Papajewski et al.

[11] 4,211,373

[45] Jul. 8, 1980

[54] THREAD GUIDING SYSTEM FOR SEWING MACHINE BOBBIN WINDERS

[75] Inventors: Reinhold Papajewski, Stutenesee; Helmar Holl; Ulrich Schmedtkord, both of Karlsruhe, all of Fed. Rep. of Germany

[73] Assignee: The Singer Company, Stamford, Conn.

[21] Appl. No.: 5,621

[22] Filed: Jan. 22, 1979

Related U.S. Application Data

[63] Continuation-in-part of Ser. No. 834,206, Sep. 19, 1977, abandoned.

[51] Int. Cl.[3] ..... B65H 54/18; B65H 63/08

[52] U.S. Cl. ..... 242/20; 112/279; 112/302; 242/22

[58] Field of Search ..... 242/20, 21, 22, 23, 242/24, 147 R, 153, 154, 157 R; 112/279, 302

[56] References Cited

U.S. PATENT DOCUMENTS

| | | | |
|---|---|---|---|
| Re. 7,205 | 7/1876 | Noe | 242/24 |
| 43,839 | 8/1864 | Drake | 242/24 |
| 208,410 | 9/1878 | Meredith | 242/20 |
| 260,734 | 7/1882 | Baker | 242/24 |
| 348,638 | 9/1886 | Reynolds | 242/20 |
| 391,905 | 10/1888 | Lewis | 242/21 |
| 655,877 | 8/1900 | Kissel, Jr. et al. | 242/24 |
| 770,179 | 9/1904 | Legg | 242/21 |
| 785,812 | 3/1905 | Legg | 242/21 |
| 2,784,917 | 3/1957 | Bono | 242/22 |
| 3,317,977 | 5/1967 | Stanley | 242/147 R |

*Primary Examiner*—Stanley N. Gilreath
*Attorney, Agent, or Firm*—James M. Trygg; Robert E. Smith; Edward L. Bell

[57] ABSTRACT

A thread guiding system for sewing machine bobbin winders in which the last thread constraining eyelet is positioned laterally centrally of the bobbin spindle and a plurality of smooth surface guide pins are positioned between the thread constraining eyelet and the bobbin with the axis of each pin parallel to that of the bobbin spindle. The pins exert no lateral influence on the thread which is allowed to move freely along the pins. With this construction the distance from the last thread constraining position to the bobbin is greatly reduced from that normally required for smoothly winding thread uniformly about the bobbin.

2 Claims, 3 Drawing Figures

THREAD GUIDING SYSTEM FOR SEWING MACHINE BOBBIN WINDERS

BACKGROUND OF THE INVENTION

This is a continuation-in-part of U.S. Patent application Ser. No. 834,206 filed Sept. 19, 1977, now abandoned.

Bobbin thread winding arrangements for sewing machines have as a main object the even distribution of thread onto the bobbin in order to maximize the amount of thread carried by a given bobbin so that the maximum number of stitches can be sewn before the bobbin must be replenished with thread. This is particularly important for industrial sewing machines since the time spent in winding is nonproductive. Various level-wind guiding attachments are known for distributing the thread onto the bobbin. However, since these devices have additional moving parts including a special drive for moving the guide back and forth, they have been replaced to a large extent by winders that do not include the moving guide element. The difficulty with these latter winders is that in order to wind the thread evenly onto the bobbin the last constraining thread guide must be spaced a substantial distance from the bobbin. The larger the radius of movement of the thread from the thread guide to the bobbin, the closer the thread path approaches linearity and the more evenly the thread is distributed on the bobbin. There is some minimum distance, or length, from the thread guide to the bobbin which affords an acceptable but not necessarily perfectly level wind. This is a function of the width of the thread bearing portion of the bobbin and establishes a length/width proportion or ratio that is well known in the prior art. Experience has shown, for example, that this length/width ratio approximates 12:1 for typical household sewing machines operating under usual sewing conditions. That is, a minimum length of 120 mm is required to achieve an acceptable wind on a bobbin of 10 mm width in those cases. This length/width ratio, however, can vary depending on the characteristics of the thread being wound, air humidity, and the dynamics of the winding mechanism. There are situations that dictate a nearly perfect level wind on the bobbin such as where a high production machine contains a bobbin that is not easily accessible and economic constraints require that machine-down-time be minimized. In these cases it is sought to wind a maximum amount of thread on the bobbin thereby requiring a length/width ratio much larger than that required in a less stringent production environment. Each production environment, then, dictates an appropriate length/width ratio to satisfy the needs of that environment. Obviously, this length/width ratio is limited by practical considerations including the available space on the sewing machine. Space consideration takes on greater significance when machines having more than one needle are involved, since a number of bobbin winders are then required. Winders having large winding radii can clutter the machine to interfere with certain operations and detract from the machines appearance.

SUMMARY OF THE INVENTION

The present invention overcomes these difficulties of the prior art by making use of the principle that a solid moving on a level plane will be subjected to the minimum friction in the direction normal to the plane of movement if the solid is allowed sufficient freedom of movement. Thus, the last lateral constraint from the thread supply is disposed in the bobbin winding arrangement of this invention in a plane that is substantially normal to the axis of the bobbin to be wound and intermediate the bobbin flanges, i.e. at substantially the center of the wound bobbin, and a plurality of smooth surface guide members each having its axis parallel to that of the bobbin axis and of a sufficient length so that there is sufficient freedom of movement axially to minimize the friction. The pins are as long as, and preferably longer, than the bobbin spindle. The thread, with regard to its lateral deflection consistency relative to the path of movement, therefore behaves between the bobbin and the last guiding constraint as a freely moving, or unguided, thread would behave. This allows the last guiding constraint and guide members to be placed relative to the bobbin axis such that the thread path from the last guiding constraint to the bobbin axis is folded about the guide members while the linear distance from the last guiding constraint to the bobbin receiving spindle is equal to or less than the linear distance from any guide member to the bobbin receiving spindle. A more detailed explanation of the interrelationship of these distances is given below in the Detailed Description of the Preferred Embodiment. This results in a condensed structure while maintaining the thread path length required by the appropriate length/width ratio necessary for evenly winding and distributing the thread over the bobbin. This is what is meant by compactness as used herein.

Consequently, it is a primary object of this invention to provide a compact bobbin winding system for sewing machines.

Another object of this invention is the provision of combining with a bobbin winder for a sewing machine the disposition of the last lateral thread constraint in a plane substantially normal to the center of the bobbin axis and the disposition of relatively long smooth surface guide members parallel to the bobbin axis so that they exert minimal lateral constraint on the thread.

BRIEF DESCRIPTION OF THE DRAWINGS

Other objects and advantages of this invention will best be understood upon reading the following detailed description of the invention with the accompanying drawings, in which.

DETAILED DESCRIPTION OF THE PREFERRED EMBODIMENT

Figure 1:
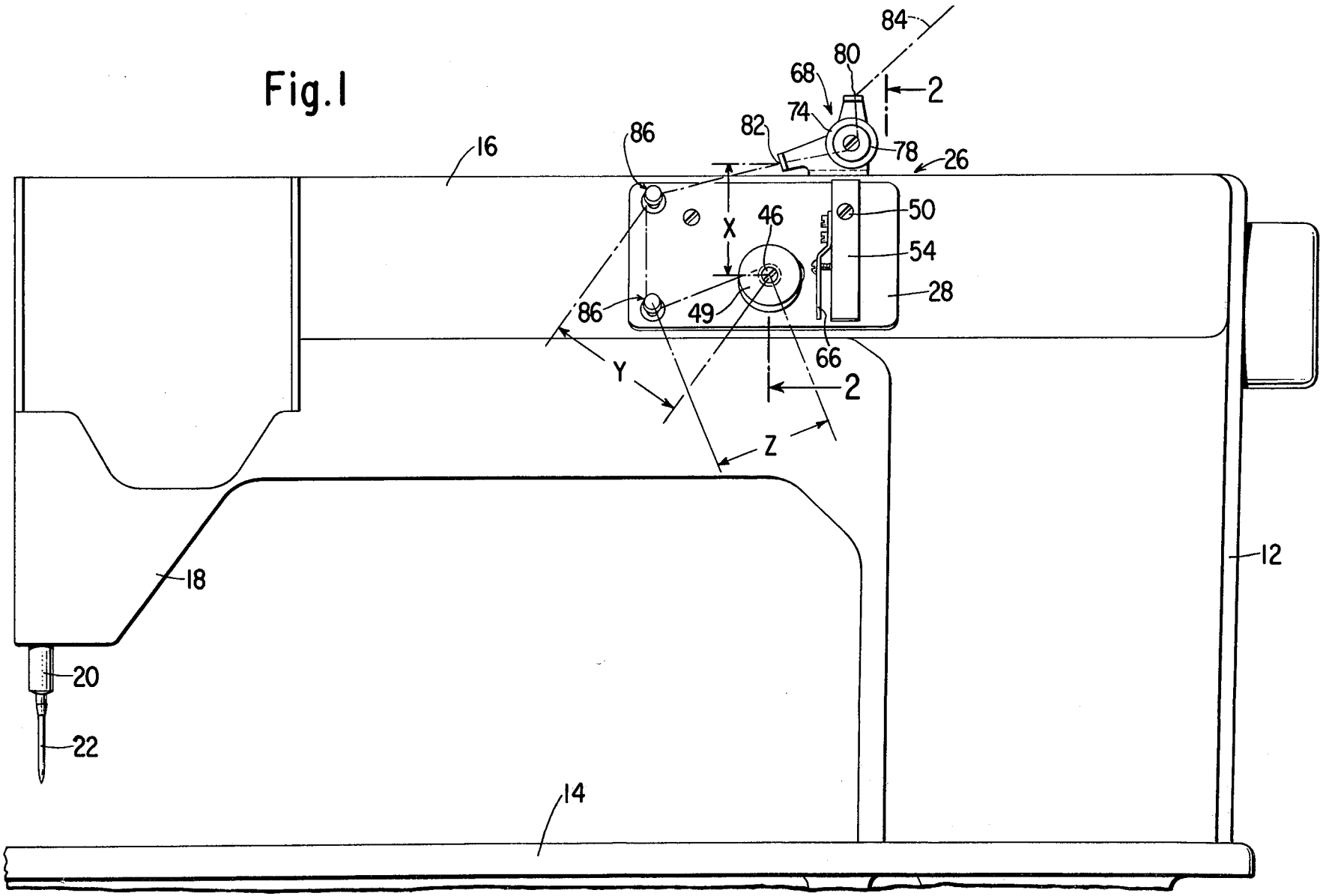
FIG. 1 is an elevational view of a portion of a sewing machine having a bobbin winder incorporating the features of the present invention.

Referring now to the drawings the arm portion of an industrial sewing machine is illustrated in FIG. 1 and conventionally includes a standard 12 rising from a bed 14, a bracket arm 16 extending from the standard and terminating in a sewing head 18 overlaying the bed. Mounted in the head 18 for endwise reciprocation is a needle bar 20 carrying at least one needle 22 at its lower end for cooperating with a respective loop seizing member (not illustrated) in the bed to form a loop and to concatenate the thread carried by the needle with thread in the bobbin associated with the loop seizing member. The needle bar may be driven in a notoriously well known manner from a main shaft 24 which may also be driven in a well known manner from a motor (not illustrated).

When the bobbin or bobbins carrying the underbed thread is depleted of the thread, it must be replenished with thread or replaced by another fully wound bobbin. To this end the sewing machine incorporates a bobbin winder generally indicated at 26 which in the preferred embodiment is carried by a plate or bracket 28, mounted by conventional means on the bracket arm 16 about an opening 30 in the arm. Carried in a bore of a boss 32 on the rear face of the bracket 28 is a stud shaft 34 which pivotally supports a drive-throw-out lever 36. The lever 36 journally supports a shaft 38 below the pivot stud 34 which extends through the lever at both faces thereof. A friction wheel 40 is secured to one end of the shaft 38 by means such as a mounting collar 42 adjacent the face of the lever that faces the interior of the bracket arm. The other end of the shaft 38 carries a bobbin supporting disk 44 adjacent the front face of the plate or bracket 28 and a bobbin supporting spindle 46 having a split end is secured to the disk and faces toward the exterior of the machine. A conventional bobbin 47 having flanges 49, 49' may be positioned on the spindle 46 abutting the disk 44.

Another boss 48 on the rear face of the bracket 28 journally supports a stud shaft 50 which carries a control cam 52 on the interior extension thereof and a control arm 54 on the exterior extension thereof. A coil spring 56 acts between the lever 36 and an ear 58 on the rear of the bracket 28 to bias the lever in a direction so that the extremity of the portion above the pivot shaft 34 engages the cam. The cam is substantially cylindrical and has a notch 60 formed in a surface thereof. A torsion spring 62 is coiled about the boss 48 and has one end secured to the cam 52 and its other end wrapped about the boss 32. This urges the cam and the control arm 54 in the direction so that the control arm is biased toward the bobbin spindle 46 which also positions the cylindrical surface of the cam in engagement with the upper extremity of the lever 36. The lever 36 is thus urged to pivot about the stud shaft 34 effecting a movement of the wheel 40 toward the right as viewed in FIG. 3.

Secured on the main shaft 24 is a friction drive wheel 64 which is located such that when the driven wheel 40 is positioned as just described the wheel 64 will be in engagement with the driven wheel 40. Rotation of the drive wheel with the main shaft effects a rotation of the driven wheel 40 and thus the spindle 46 and the bobbin 47 positioned thereon. Consequently, in order to wind thread on the bobbin, the arm 54 is manually pivoted toward the bobbin causing the cam to push up on the upper extremity of the lever 36 to rotate the same until the cylindrical surface of the cam engages the lever. A contact spring 66 is secured to the arm on the bobbin side and engages the bobbin. As the bobbin fills with thread, the spring 66 and the arm 54 are pushed counterclockwise toward the right as viewed in FIG. 1, and with it the cam 52 with the upper end of the lever 36 following the cam surface. When the bobbin is fully wound, as determined by the spring 66, the arm 54 has moved until the upper extremity of the lever 36 is positioned within the notch 60. At this point the driven wheel 40 is completely disengaged from the drive wheel 64 and stops rotating.

Figure 3:
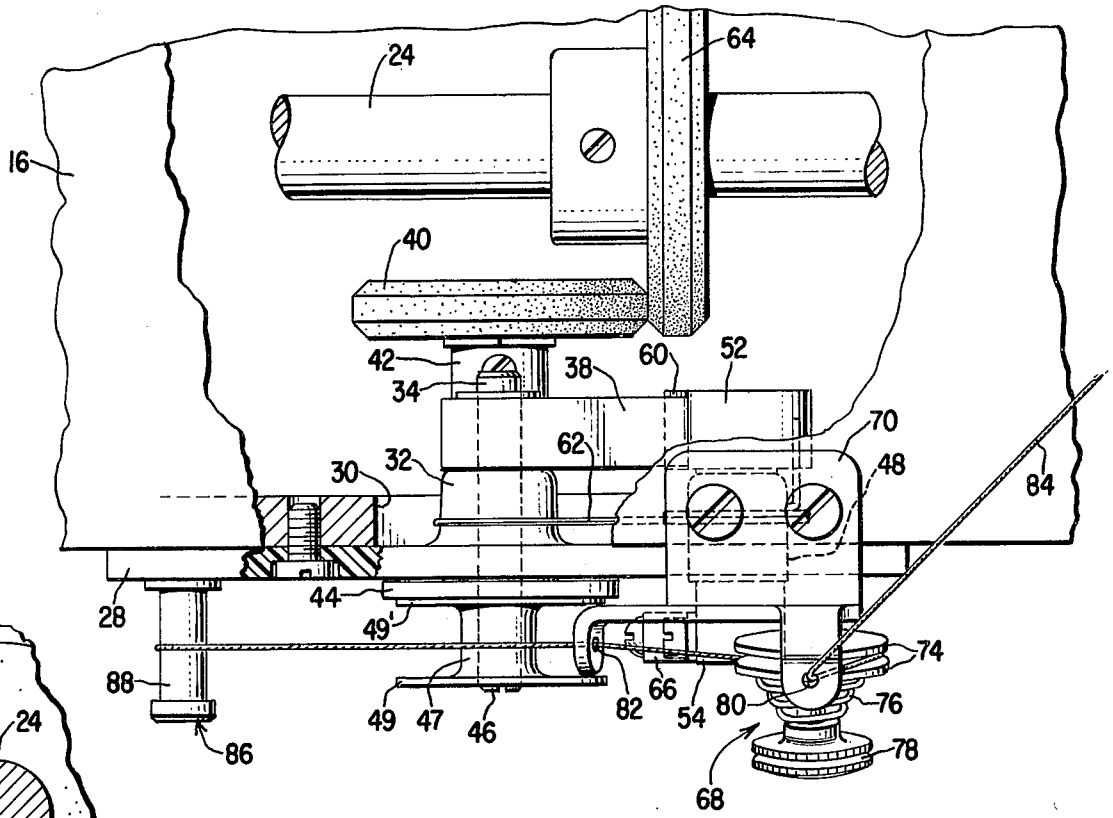
FIG. 3 is a partial top plan of the sewing machine of FIG. 1 with parts thereof broken away and sectioned.
Figure 2:
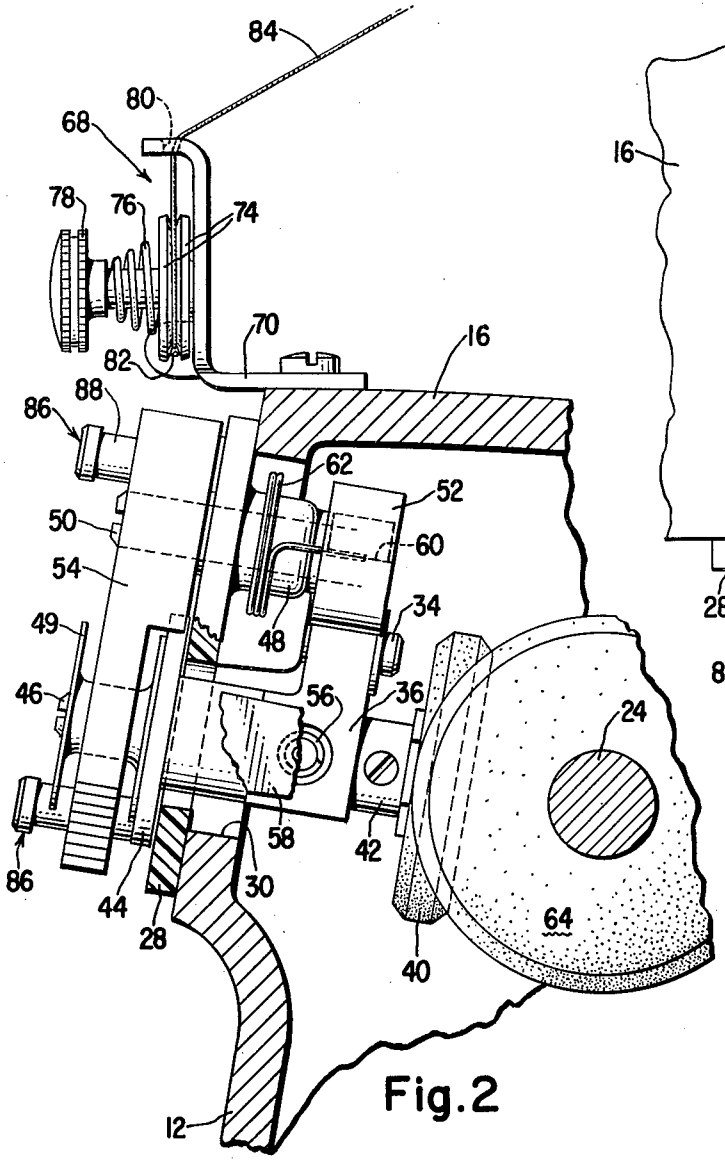
FIG. 2 is a fragmentary cross sectional view taken along lines 2—2 of FIG. 1.

Mounted on the sewing machine bracket arm, preferably in the vicinity above the bracket 28, is a thread guide and tension assembly 68. It comprises a bracket 70 supporting a stud shaft 72 on which is carried a pair of tension disks 74 biased by a helical compression spring 76. The spring 76 is controlled by a knob 78 threaded onto the shaft 72 to control the contact force between the disk 74. The bracket 70 also carries a first thread guide eyelet 80 and the second thread guide eyelet 82. The eyelet 82 defines the last thread constraint prior to the winding mechanism. Thread 84 passes through the eyelet 80, is partly wound between the disks 74 and then is threaded between the eyelet 82. The eyelet 82, as illustrated in FIG. 3, is positioned in a plane substantially normal to the axis of spindle 46 and midway between the flanges of the bobbin 47. Thus, the eyelet laterally constrains the thread relative to the bobbin at the center thereof. It is the last such constraint provided by the invention.

Mounted on the bracket 28, spaced from the spindle 46 are a plurality of guide pins 86. In the preferred embodiment there are two such guide pins. The axis of each guide pin 86 is substantially parallel to the axis of the bobbin winder spindle 46 and has a highly polished thread engaging surface 88 that is of the length at least substantially as long as the effective length of the bobbin spindle 46, i.e., the length of the spindle that supports the bobbin. As shown in FIG. 1, the guide pins 86 and the eyelet 82 are spaced such that the linear distance X from the eyelet 82 to the bobbin spindle 46 is equal to or less than the linear distances Y and Z from the guide pins 86 to the bobbin spindle 46. That is, the eyelet 82 is as close to or closer to the bobbin spindle 46 than are any of the guide pins 86. With this arrangement, the thread 84 from the eyelet 82 is trained about the guide pin surfaces 88 in seriatim and secured to the bobbin. As the bobbin is rotated, as described above, the thread from the eyelet 82 is free to move laterally, or axially along the polished surfaces 88, as a freely moving solid. The friction is minimized and the thread behaves as an unguided thread would. In practice it is found that optimum results occur when the path length from the eyelet 82 to the bobbin is approximately that which a fully guided prior art arrangement required. However, by the present invention, the path is compacted within the small confines of the bracket, rather than the extended path required by the prior art constructions.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

We claim:

1. In a sewing machine having a drive means for driving sewing instrumentalities, a thread supply, a thread guide having a thread constraining aperture for constraining the thread from the supply, a winding mechanism including a winder shaft with a bobbin receiving spindle of a finite bobbin supporting length and means operatively and selectively connecting the winder shaft to the drive means for rotating the winder shaft and the spindle, the improvement comprising, means for mounting said thread guide relative to said winder such that said thread constraining aperture is disposed in a plane substantially normal to the axis of said spindle intermediate the length thereof, and a plurality of spaced guide members each having a low friction thread engaging surface, said surface being straight, substantially parallel to the axis of said spindle, and of a length at least equal to that of said bobbin supporting length for folding the thread path, said thread path originating at said thread constraining aperture, folding about said guide members in seriatim and terminating at said spindle, the total length of said thread path bearing a predetermined proportion or ratio to the bobbin supporting length of said bobbin receiving spindle, the distance from said thread constraining aperture to said bobbin receiving spindle being equal to or less than the distance from any said guide member to said bobbin receiving spindle.

2. In a sewing machine as recited in claim 1 wherein said sewing machine has a housing supporting said thread guide, a bracket for supporting said winding mechanism and said guide members, and means for mounting said bracket on said housing adjacent said thread guide such that said thread constraining aperture and guide members are all spaced substantially equidistant from said bobbin receiving spindle.

* * * * *